US007963394B2

(12) United States Patent
Facey et al.

(10) Patent No.: US 7,963,394 B2
(45) Date of Patent: Jun. 21, 2011

(54) PALLETISED LOADS OF CONTAINERS

(75) Inventors: Hugh David Facey, Sheffield (GB); Derek Boaler, Sheffield (GB); John Makin, South Yorkshire (GB)

(73) Assignee: Loadhog Limited (GB)

( * ) Notice: Subject to any disclaimer, the term of this patent is extended or adjusted under 35 U.S.C. 154(b) by 969 days.

(21) Appl. No.: 11/720,092

(22) PCT Filed: Sep. 21, 2005

(86) PCT No.: PCT/GB2005/003608

§ 371 (c)(1),
(2), (4) Date: May 24, 2007

(87) PCT Pub. No.: WO2006/059054

PCT Pub. Date: Jun. 8, 2006

(65) Prior Publication Data

US 2009/0223856 A1 Sep. 10, 2009

(30) Foreign Application Priority Data

Dec. 3, 2004 (GB) ..... 0426517.9
Dec. 23, 2004 (GB) ..... 0428145.7

(51) Int. Cl.
*B65D 19/00* (2006.01)

(52) U.S. Cl. ..... 206/386; 428/221

(58) Field of Classification Search ..... 206/386, 206/595, 596, 597, 600; 428/115, 119, 120, 428/192, 221

See application file for complete search history.

(56) References Cited

U.S. PATENT DOCUMENTS

| | | | | |
|---|---|---|---|---|
| 3,217,875 | A | 11/1965 | Scheibel | |
| 5,102,036 | A * | 4/1992 | Orr et al. | 229/89 |
| 5,339,577 | A * | 8/1994 | Snyder | 52/95 |
| 7,426,890 | B2 * | 9/2008 | Olvey | 108/51.3 |
| 2001/0032432 | A1 * | 10/2001 | Paxton et al. | 52/311.2 |
| 2006/0113365 | A1 * | 6/2006 | Grigsby et al. | 229/122.27 |
| 2006/0138205 | A1 * | 6/2006 | Keefe et al. | 229/179 |

FOREIGN PATENT DOCUMENTS

| | | |
|---|---|---|
| DE | 1037965 | 8/1958 |
| DE | 9006099 | 9/1990 |
| DE | 4339445 | 5/1995 |
| DE | 29921226 | 2/2000 |
| EP | 1291306 A1 | 3/2003 |
| FR | 2593782 A1 | 8/1987 |

* cited by examiner

*Primary Examiner* — Jacob K Ackun, Jr.
(74) *Attorney, Agent, or Firm* — Clark Hill PLC

(57) ABSTRACT

A preferred form of slip sheet (62) for use between layers (L) of containers, especially bottles (20), in a palletised load, comprises a rectangular board (63) having marginal portions (34) formed with corrugations (65, 66) extending perpendicular from their edges and merging into the general plane of the board (63), whereby, in use, a 'throat' (TD) is formed between the upward corrugations (66) on a lower slip sheet (62) and the downward corrugations (65) on an upper slip sheet (62) which prevents 'walking' of the outermost rows of bottles (20) in the intervening layer. Curved corners of the board (63) are provided with diverging corrugations (65X, 66X) to prevent 'walking' of bottles (20) from the corners of layers (L). A plurality of such slip sheets (62) can be stacked compactly and with great stability by virtue of the corrugations (65, 66) nesting in the corrugations of neighbouring slip sheets.

7 Claims, 9 Drawing Sheets

PALLETISED LOADS OF CONTAINERS

This invention relates to palletised loads of containers, such as illustrated by FIGS. 1 to 3 of the accompanying drawings and in which:—

Figure 1:
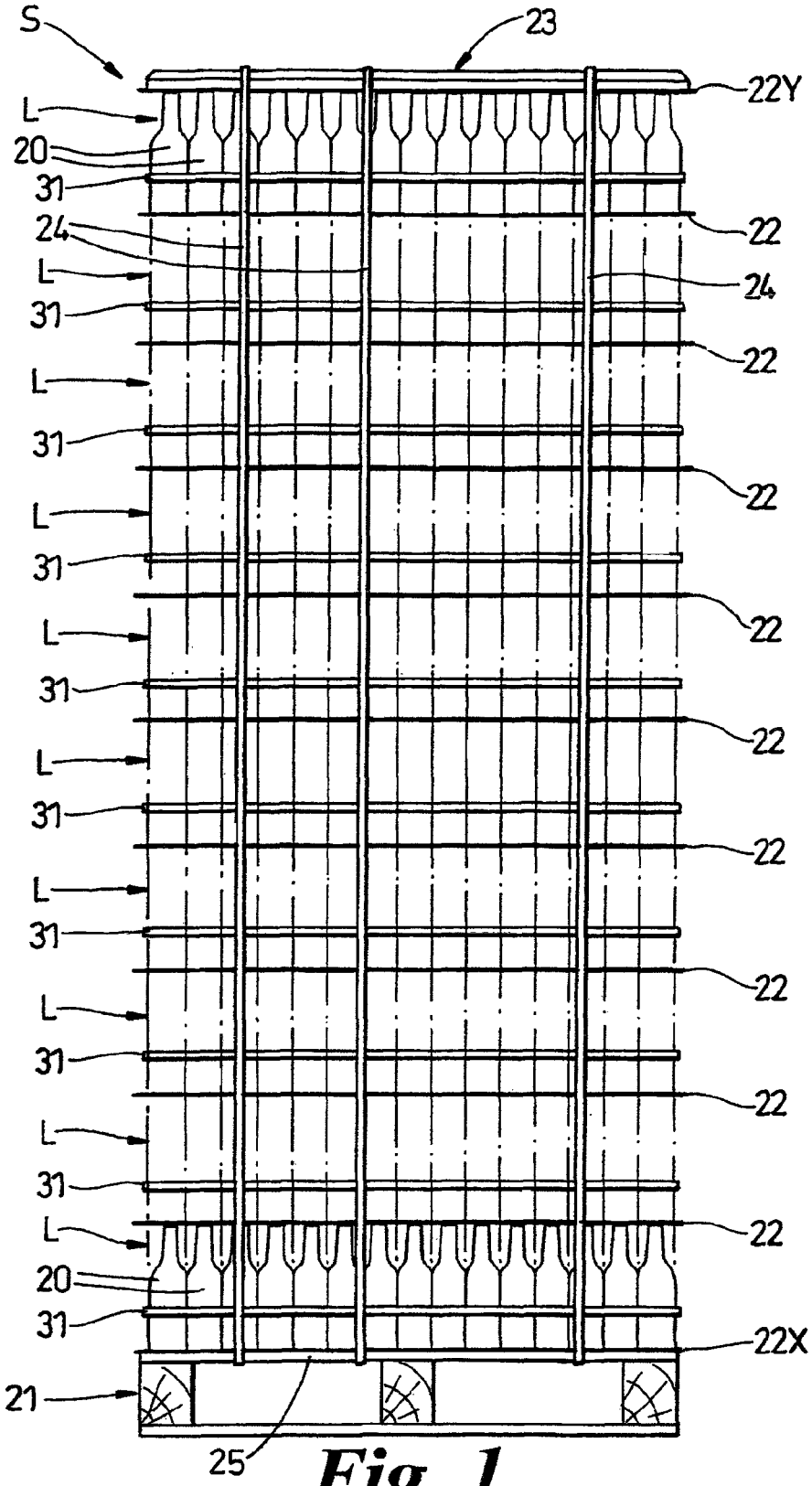
Fig. 1 (Prior Art)
FIG. 1 is an end elevation of a palletised load of bottles in accordance with a prior art method of stacking them on and strapping them to a pallet.
Figure 2:
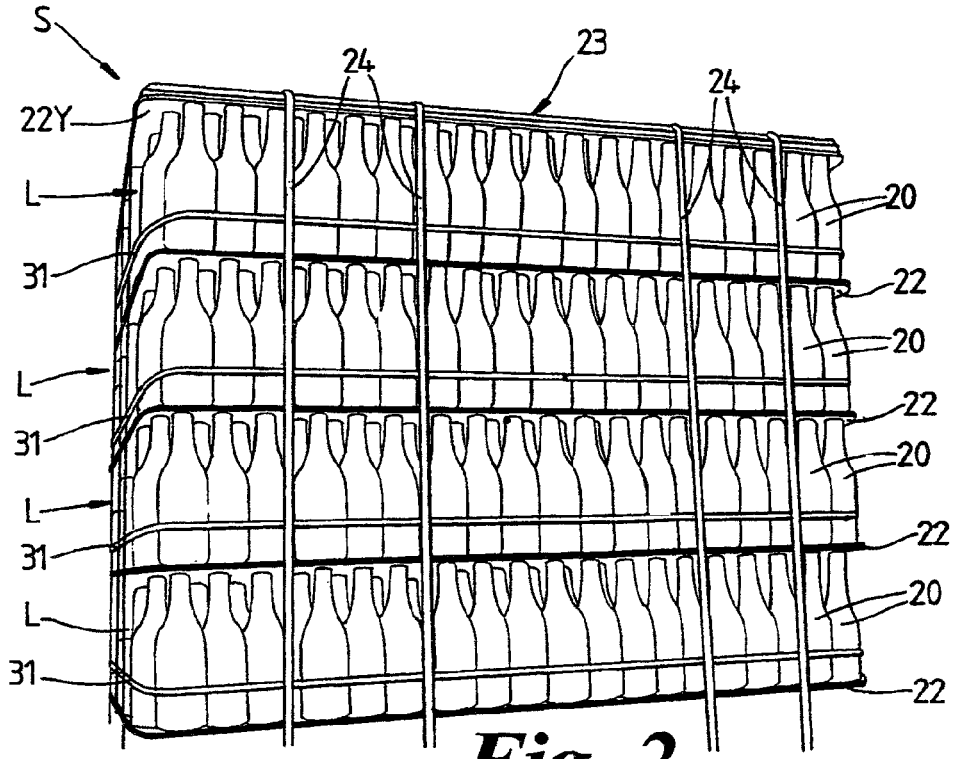
Fig. 2 (Prior Art)
FIG. 2 is a fragmentary view from one side of the top four layers of bottles of FIG. 1.
Figure 3:
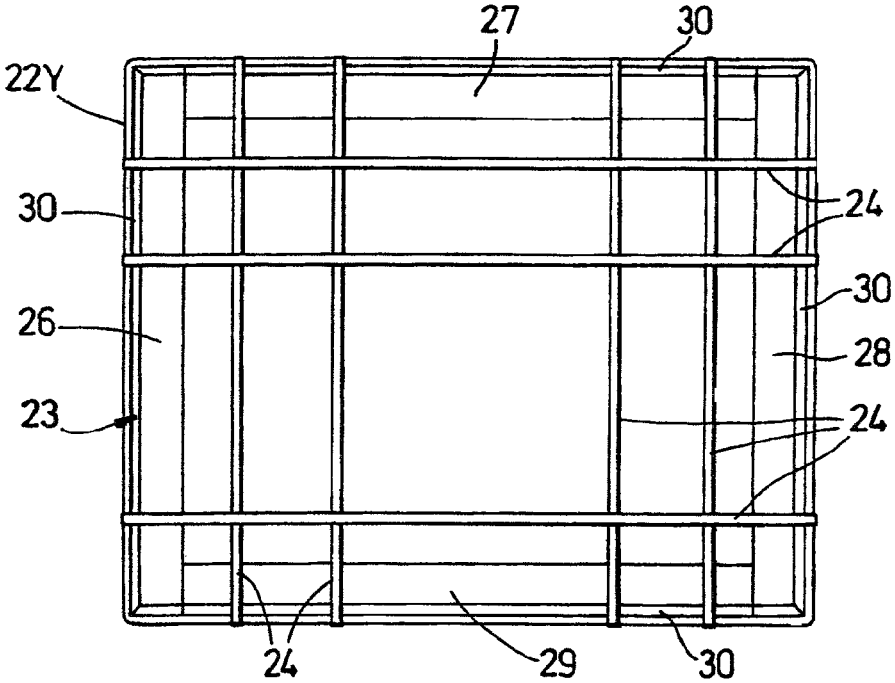
Fig. 3 (Prior Art)
FIG. 3 is a plan view of the palletised load.

In FIGS. 1 to 3, upright containers, such as bottles 20 (as shown) or cans, are stacked automatically in layers L on a pallet 21 (or a dolly) with slip sheets 22 (also known as layer pads), e.g. of polypropylene of the order of 2.0 to 4.0 mm thickness, between the layers, and also one 22X below the bottom layer, each successive slip sheet being placed on top of a layer of containers and each successive layer of containers being pushed en masse or lowered from above on to the preceding slip sheet, the completed stack S being topped-off by a slip sheet 22Y and a rigid board 23 which is subjected to a downward loading, e.g. of 2 to 3 tons, by means not shown, to compact the layers and slip sheets whilst strapping 24 is automatically applied vertically, by means not shown, between the pallet 21 and the board 23, across under the platform 25 of the pallet and across the top of the board.

As indicated by FIG. 3, the board 23 is usually formed by four lengths of wood 26, 27, 28, 29, e.g. each 97 mm wide and 17 mm thick, joined together to form a rectangle having outside dimensions commensurate with the dimensions of the pallet. The upper outer edges 30 of the board are bevelled (as shown) or rounded to reduce high stress points in the strapping 24.

Because the strapping 24, after securing ends together (not shown) before removing the downward loading, is of finite length, any subsequent settling of the stack S, e.g. due to variation in bottle height, e.g. plus or minus up to 1.0 mm, and/or vibration and/or stretching of the strapping 24, especially resulting from temperature rise subsequent to the strapping operation, results in loss of tension in the strapping that can lead to instability of the stack, especially as vibration or shock loading of the palletised load during transport can cause 'bottle-walking' (or 'can-walking') from within the confines of the slip sheets 22, with disastrous results, especially breaking of bottles.

It is, therefore, as shown in FIGS. 1 and 2, common practice to apply strapping 31 horizontally around each layer L of containers 20, but there still remains a tendency to 'walking' or slipping of a layer en masse from a palletised load. This situation can be aggravated by horizontal strapping 31 slipping down a layer L of containers 20 due to vibration.

The object of the invention is to provide slip sheets that inhibit 'walking' and prevent slipping upon shock loading.

FR-A-2 593 782 discloses a plate for closing one or more open boxes forming a pallet load, the plate having along its perimeter a series of tabs protruding upwardly and downwardly in alternation from the plane of the plate and inclined outwardly, whereby the downwardly protruding tabs locate round the tops of a lower layer of boxes on a pallet and the upwardly protruding tabs locate the bottoms of an upper layer of boxes.

FIGS. 4 to 11 of the accompanying drawings illustrate an attempt to provide a similar arrangement on a slip sheet enabling a layer of containers (particularly, but not exclusively, bottles) to be pushed laterally over one side of the slip sheet.

Figure 4:
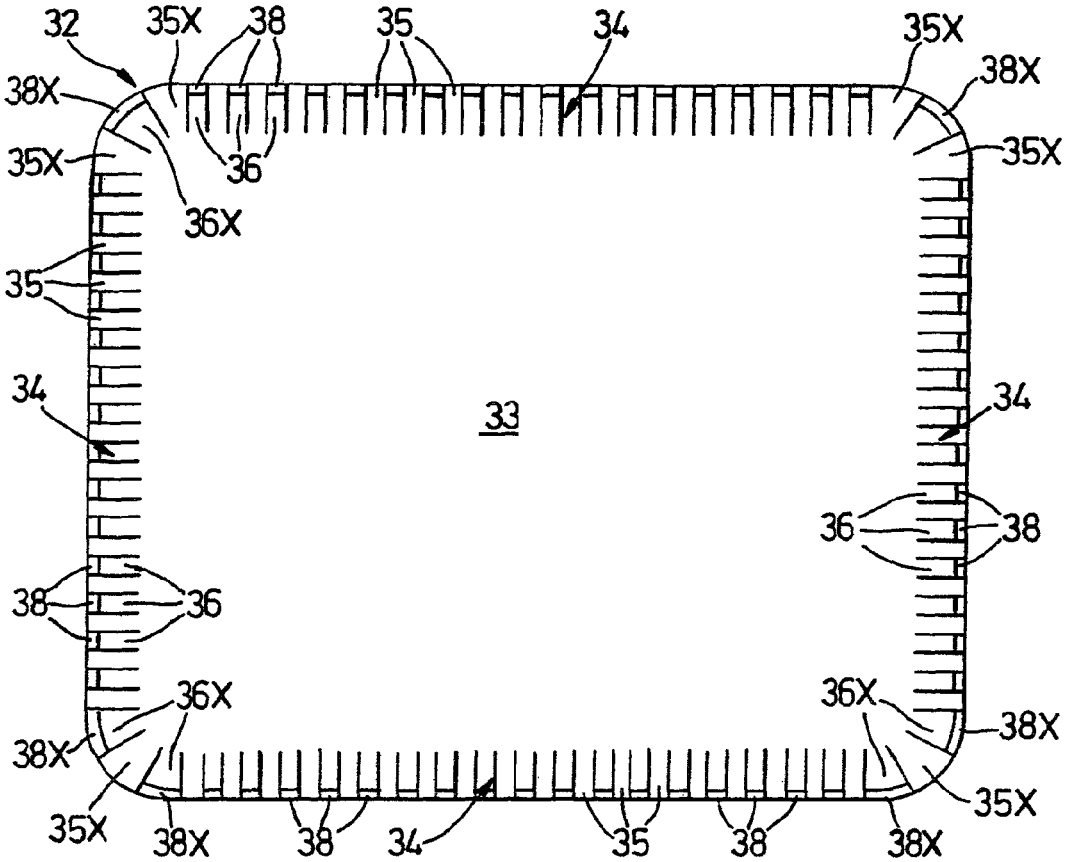
Figure 5:
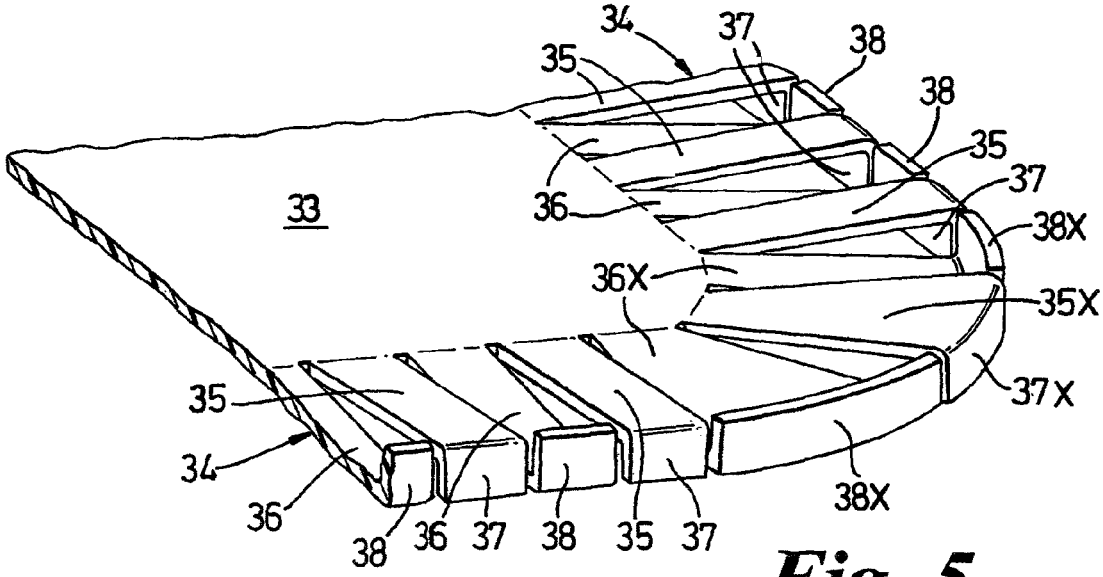
Figure 6:
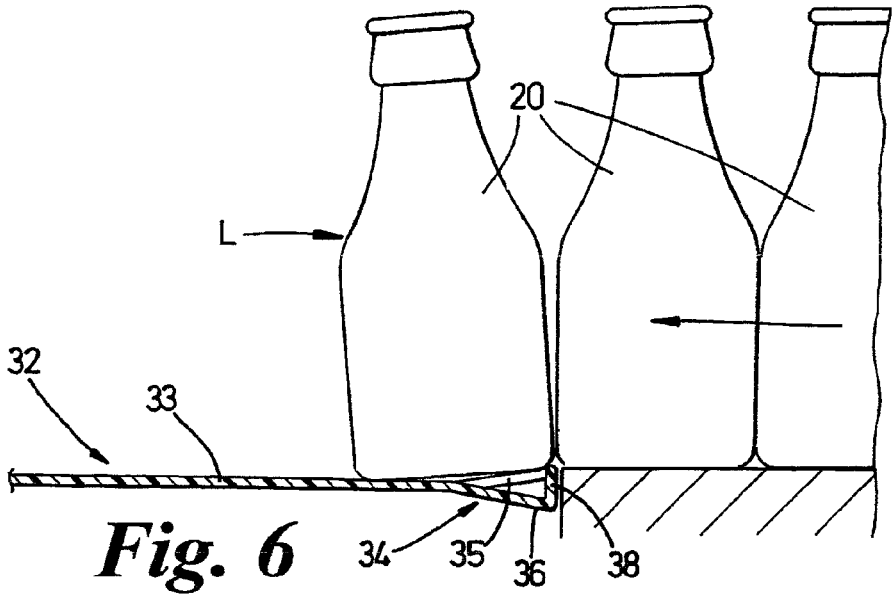
Figure 7:
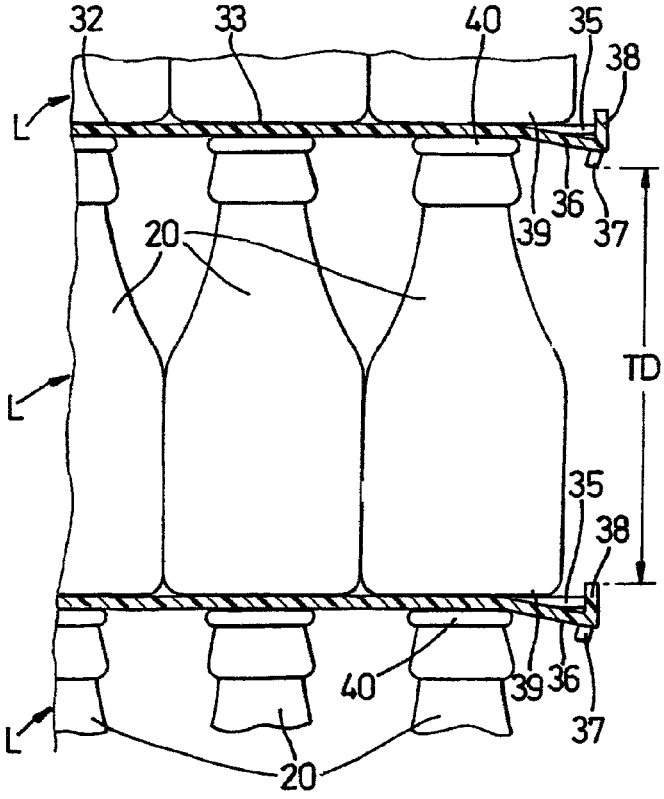
Figure 8:
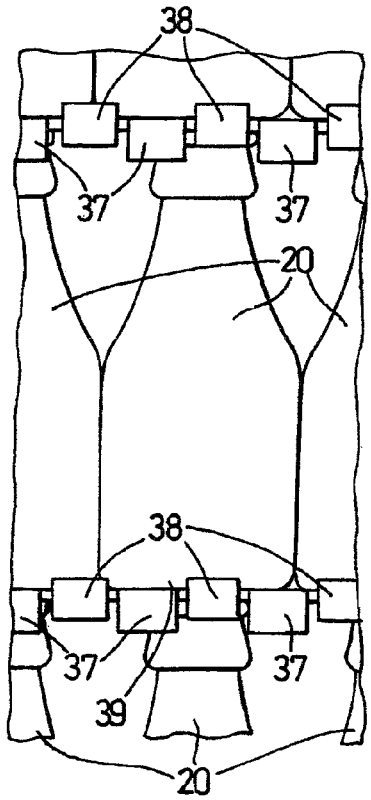
Figure 9:
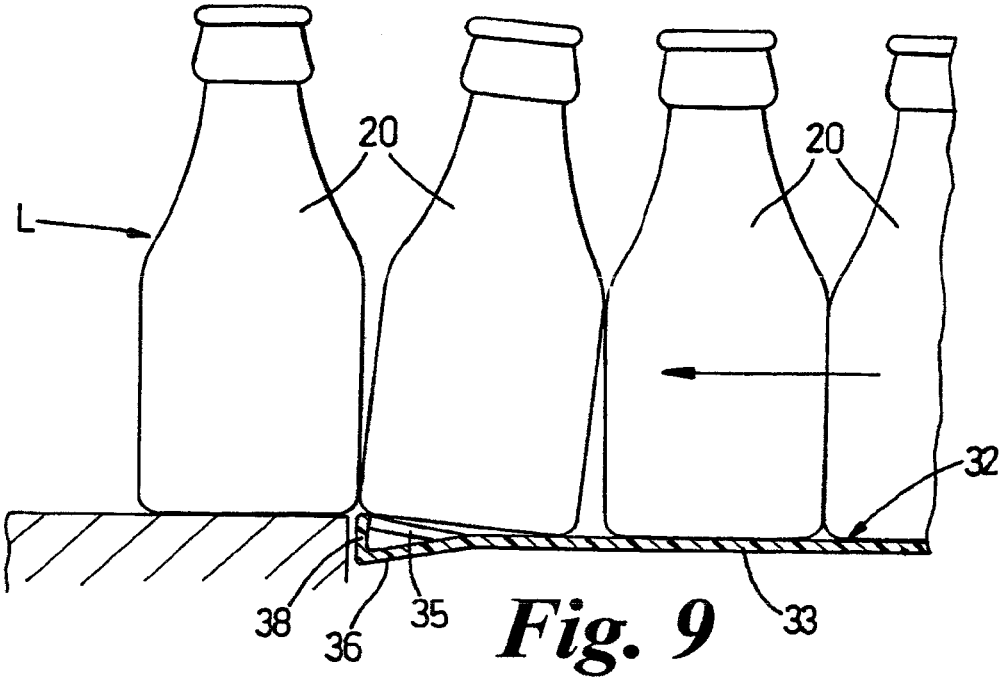
Figure 10:
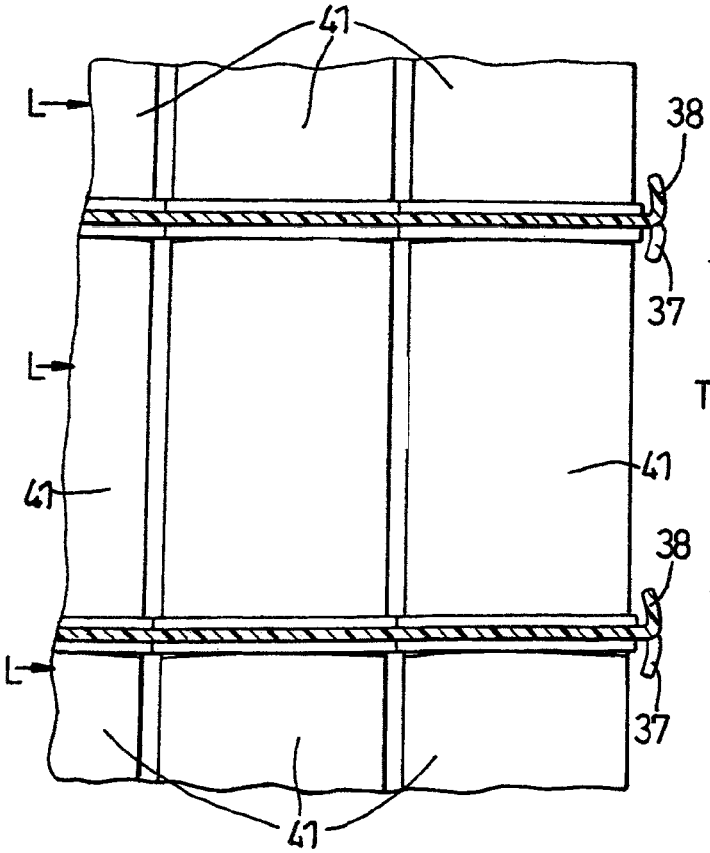
Figure 11:
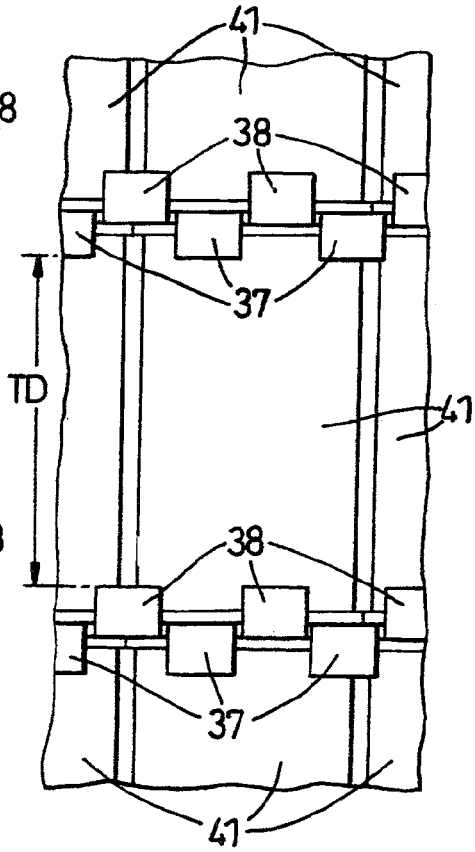

FIG. 4 is a plan view of this embodiment of slip sheet;

FIG. 5 is a fragmentary isometric view of part of the slip sheet of FIG. 4;

FIG. 6 is a part-sectional fragmentary view showing a layer of bottles starting to slide on to the slip sheet of FIGS. 4 and 5;

FIG. 7 is a part-sectional fragmentary view showing how a successive pair of slip sheets as in FIGS. 4 and 5 prevent walking of an intervening layer of bottles;

FIG. 8 is a fragmentary elevation seen from the right-hand side of FIG. 7;

FIG. 9 is a view corresponding to FIG. 6 but showing a layer of bottles starting to slide off the slip sheet;

FIG. 10 corresponds to FIG. 7 but with cans in place of the bottles; and FIG. 11 is a fragmentary elevation seen from the right-hand side of FIG. 10.

The form of slip sheet 32 shown in FIGS. 4 to 11 comprises a flat substantially rectangular board 33 having marginal portions 34 formed by two sets of fingers 35, 36 diverging respectively upwards and downwards in alternation and terminating in interdigitated downward and upward respective sets of projections 37, 38.

As indicated by FIG. 6, the upwardly inclined fingers 35 enable a layer of bottles 20 to slide down on to the slip sheet 32 as the bottles are pushed laterally over one side on to the board 33.

FIGS. 7 and 8 indicate that upon subsequent downward loading of that layer L of bottles, either by the weight of a further layer or layers of bottles (with a similar intervening slip sheet or slip sheets 32) or by applying to a rigid board 23 placed on top of the completed stack an external force prior to and during application of vertical strapping as in the prior art, the upwardly inclined fingers 35 are pressed down by the bottoms 39 of the outermost rows of bottles 20 towards the plane of the board 33, thus causing the downward projections 37 to project below the plane of the board to restrain the tops 40 of the outermost rows of bottles in the layer below, while the upward projections 38 on the undeflected fingers 36 become exposed above the plane of the board 33 to restrain the bottoms 39 of the outermost row of bottles 20 in the upper layer, and, thereby, the layers L of bottles are restrained from 'walking' or slipping under shock loading.

From curved corner portions of the board 33 radiate fingers 35X and 36X with curved downward and upward respective projections 37X and 38X to ensure that 'walking' of bottles 20 from the corners of layers L is not possible.

Upon arrival at the point of use, and after the vertical strapping 24 has been cut off and the rigid board 23 removed, the set of fingers 35 of the slip sheet below the topmost layer L of bottles 20 spring back out of the plane of the board 33, thus enabling the layer of bottles to slide up the upwardly inclined fingers 35 as the bottles are pushed laterally over a side of the slip sheet 32, as indicated by FIG. 9.

When the slip sheets 32 are used between layers L of cans 41, as shown in FIGS. 10 and 11, both sets of fingers 35, 36 are pressed towards the plane of the board 33 by the bottoms and tops respectively of the outermost row of cans, causing the projections 38 to project upwardly to restrain the bottoms of the outermost row of cans above, as well as the projections 37 projecting downwardly to restrain the tops of the outermost row of cans below.

Figure 12:
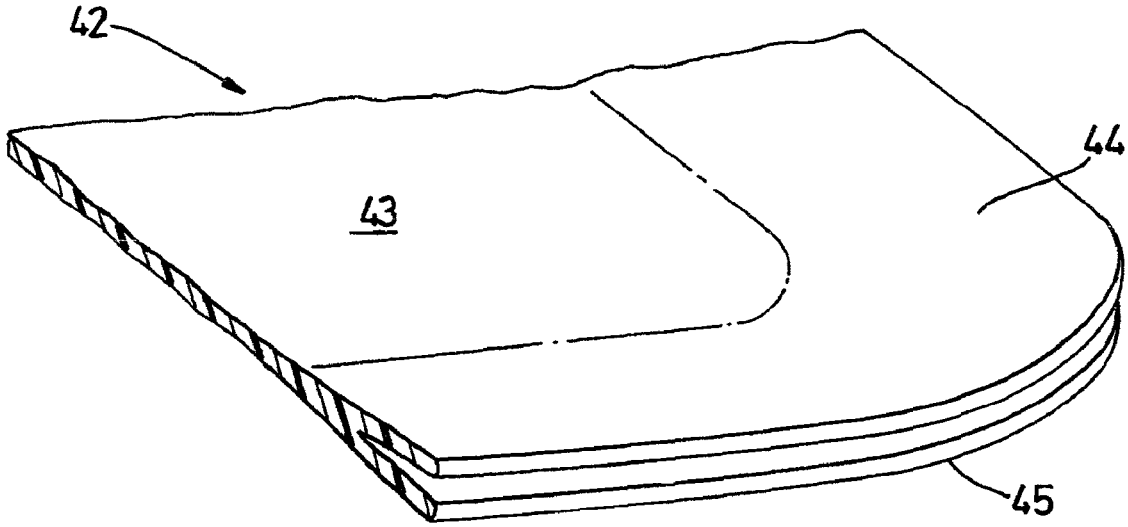
Figure 13:
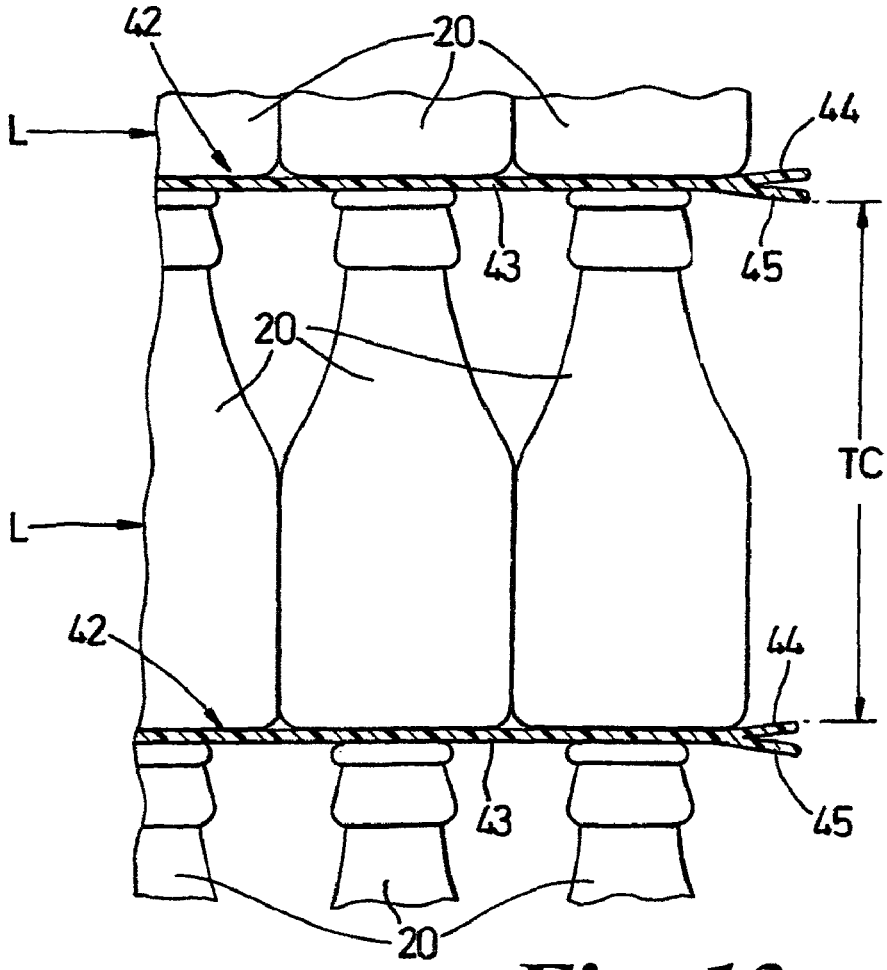

However, such projections 37, 38 and fingers 35, 36 are very liable to damage during the usual rough handling of slip sheets, and so FIGS. 12 and 13 of the accompanying drawings illustrate a first attempt to provide a more robust slip sheet, whilst also suitable for sliding containers on and off.

FIG. 12 is a fragmentary isometric view of this form of slip sheet; and

FIG. 13 is a part-sectional fragmentary view showing how a successive pair of slip sheets as in FIG. 12 prevent walking of an intervening layer of bottles.

The form of slip sheet 42 illustrated by FIGS. 12 and 13 comprises a flat rectangular board 43 having upper and lower marginal portions formed by separate leaves, 44, 45 diverging towards the edges of the slip sheet, which is more robust whilst also suitable for sliding containers on and off.

It will be appreciated that a continuous 'throat' TC is created between the outer edges of respectively the upper leaf 44 of a lower slip sheet 42 and the lower leaf 45 of an upper slip sheet 42, through which 'throat' the outermost bottles in the intervening layer L cannot walk and—indeed—could only be pulled with great difficulty. This 'throat' can be compared with the discontinuous 'throat' TD created between the upward projections 38 on a lower slip sheet 32 and the downward projections 37 on an upper slip sheet 32, which 'throat' TD is effective provided that—as shown by FIG. 8—there is at least one downward projection 37 overlapping each top 40 in the outermost row of bottles 20 in a layer L.

Reference is now made to EP-A-1 291 306 which discloses an interlay sheet for stacked layers of light-weight containers, in particular polyethylene terephthalate (PET) bottles, the sheet having upper and lower marginal portions formed by separate leaves diverging towards the edges of the sheet. Furthermore, the separate leaves are stiffened against vertical deformations by webs between them, which is relevant with regard to a second attempt to provide a more robust slip sheet as illustrated by FIGS. 14 and 15 of the accompanying drawings, in which:—

Figure 14:
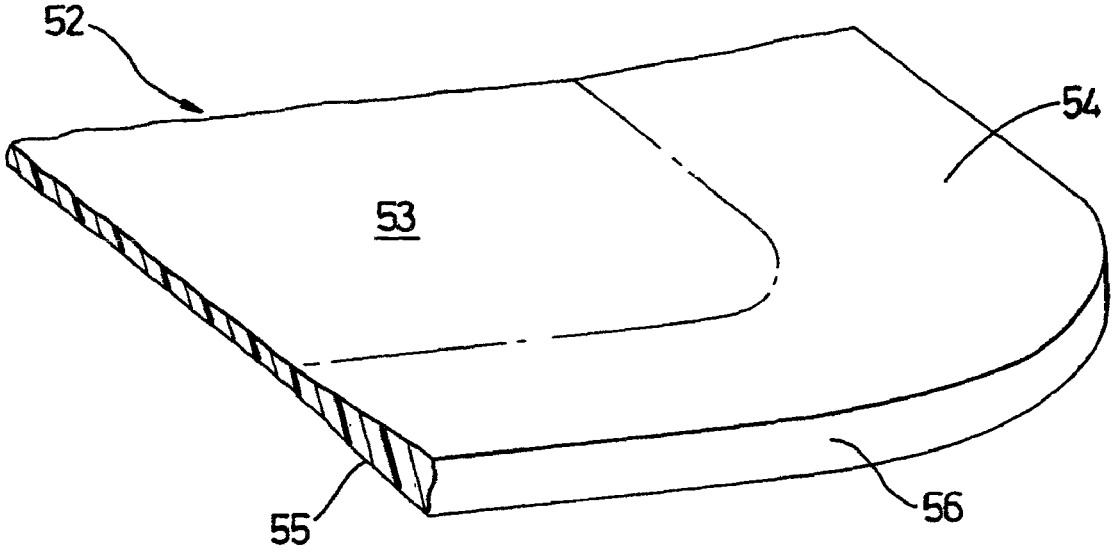
Figure 15:
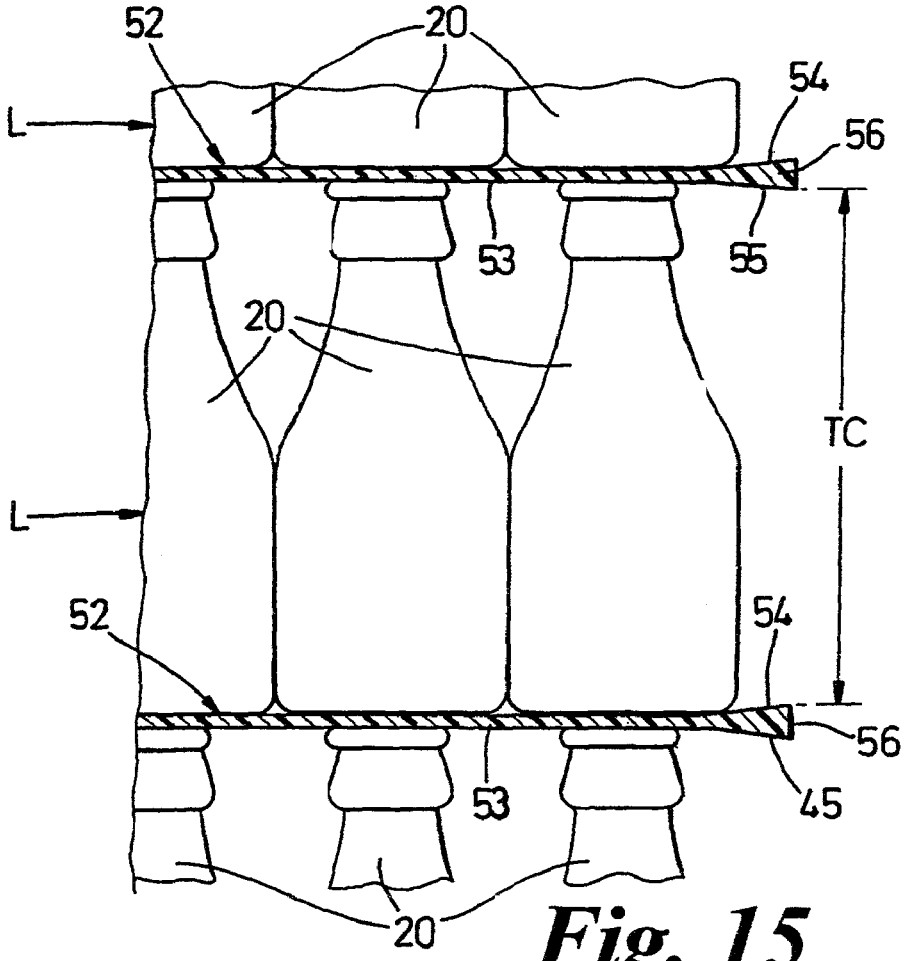

FIGS. 14 and 15 correspond to FIGS. 12 and 13 respectively, but show this further form of slip sheet in which the slip sheet 52 comprises a flat substantially rectangular board 53 having upper and lower diverging marginal portions forming the upper and lower surfaces 54, 55 respectively of a beaded edge 56 of the board, again forming a continuous 'throat' TD effective to prevent 'walking' of bottles 20 (or cans) in layers L between successive slip sheets 52.

Whichever form of slip sheet 32, 42 or 52 is adopted there is the difficulty that a plurality of such slip sheets cannot be stacked compactly for return transportation to the suppliers of the containers. Therefore it is the object of the present invention to provide a slip sheet that overcomes this difficulty.

Thus, according to one aspect of the present invention, a slip sheet comprises a flat substantially rectangular board having marginal portions formed with corrugations extending perpendicularly from their edges and merging into the general plane of the board.

In use, the downwardly projecting corrugations restrain the tops of the containers in a layer on which the slip sheet is placed, then the bottoms of the next layer of containers can slide down the upwardly projecting corrugations along one side of the slip sheet as that layer is pushed laterally en masse on to the board, whereafter the upwardly projecting corrugations restrain the bottoms of those containers. However, upon arrival at the point of use, and after the vertical strapping has been cut off and the rigid board and top slip sheet removed, the bottoms of each successive layer of containers can slide up the upwardly projecting corrugations along a side of the slip sheet below as the layer is pushed laterally en masse from the board.

The board preferably has curved corners from which radiate diverging corrugations, to ensure that 'walking' of containers from the corners of layers is not possible.

Because the corrugations can be moulded into a board of uniform thickness throughout with no increase in thickness along the sides and even a thinning towards the edges, a plurality of such slip sheets can be stacked compactly and with great stability by virtue of the corrugations of any one slip sheet nesting in the corrugations of neighbouring slip sheets.

With the thickness of the board of the order of 1.0 to 4.0 mm, a maximum height of the upwardly projecting corrugations and a maximum depth of the downwardly projecting corrugations of the order of 2.0 to 4.0 mm causes an adequate reduction of the gap or creates a 'throat' between the edges of slip sheets above and below a layer of containers to prevent 'walking' of the layer of containers en masse after strapping of a completed stack as aforesaid or prevent slipping upon shock loading.

The pitch of the corrugations is preferably such that at least one downwardly projecting corrugation is in register with each bottle top in the outermost rows, then there will be more than one upwardly projecting corrugation in register with each bottle bottom in the outermost rows.

Figure 16:
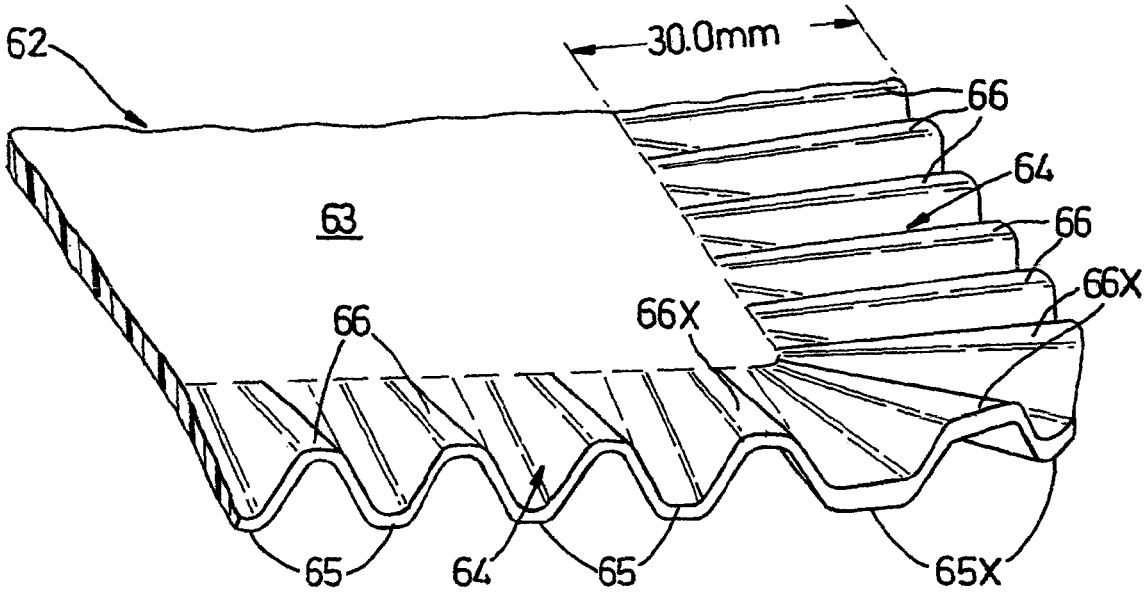
Figure 17:
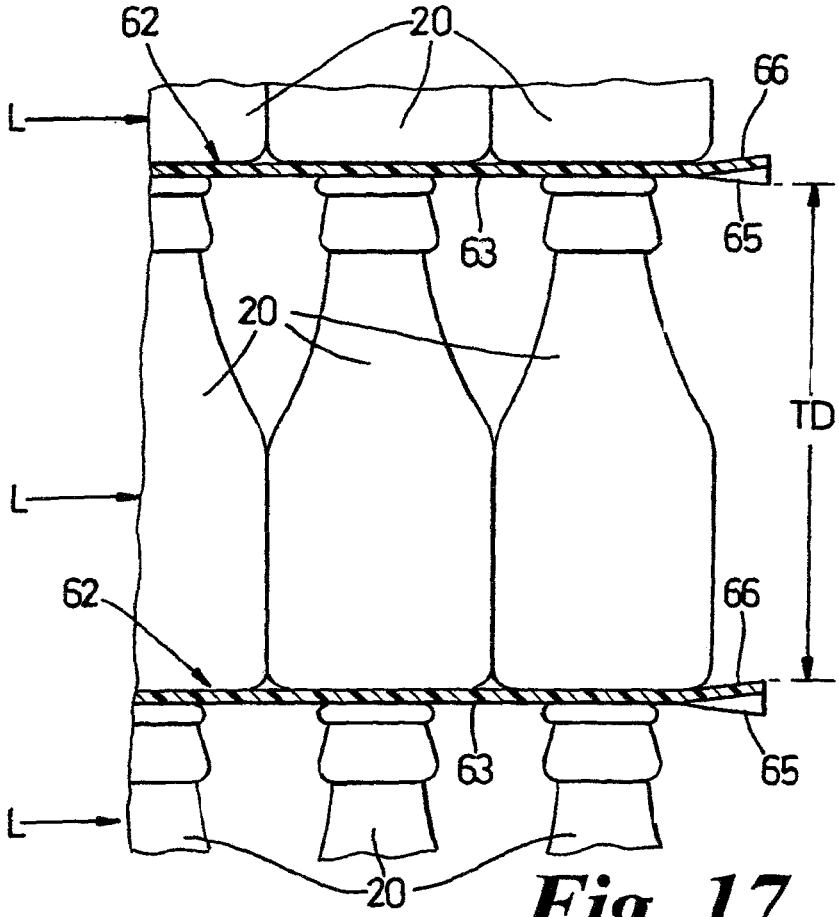
Figure 18:
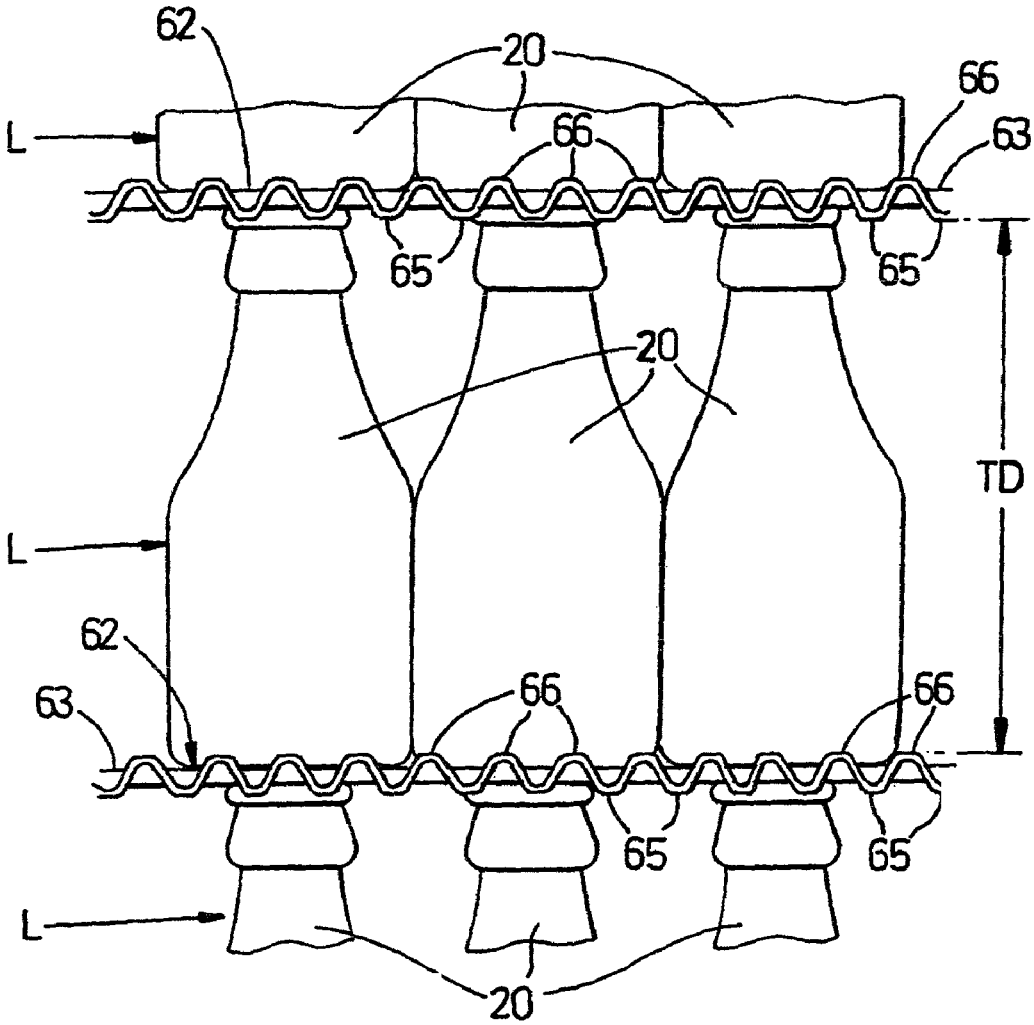
Figure 19:
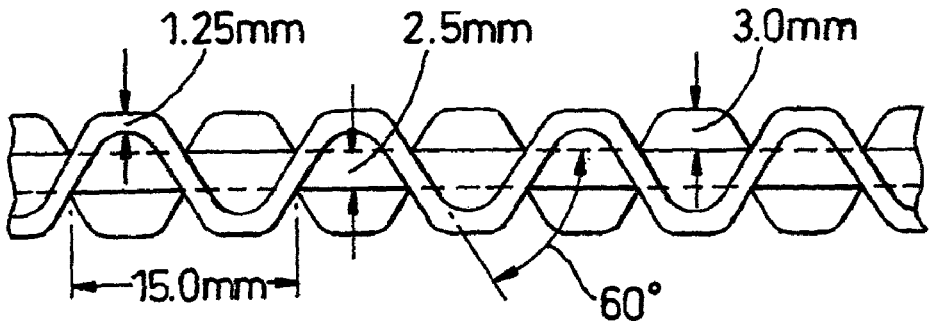

Reference will now be made to FIGS. 16 and 17 which also correspond to FIGS. 12 and 13 respectively but show a slip sheet in accordance with the invention;

FIG. 18 is a fragmentary elevation seen from the right-hand side of FIG. 17; and FIG. 19 is a fragmentary enlarged elevation of the edge of the slip sheet of FIGS. 16 to 18.

Therefore, the slip sheet 62 as shown in FIGS. 16 to 19 and in accordance with the present invention comprises a flat substantially rectangular board 63 having marginal portions 64 formed with corrugations 65, 66 extending perpendicularly from their edges and merging into the general plane of the board.

In use, the downwardly projecting corrugations 65 restrain the tops of the bottles 20 (or cans) in a layer L on which the slip sheet 62 is placed, then the bottoms of the next layer of bottles can slide down the upwardly projecting corrugations 66 along one side of the slip sheet 62 as that layer is pushed laterally en masse on to the board 63, whereafter the upwardly projecting corrugations 66 restrain the bottoms of those bottles, while their tops are restrained by the downwardly projecting corrugations 65 of the next slip sheet 62.

From curved corner portions of the board 63 radiate diverging corrugations 65X, 66X to ensure that 'walking' of bottles 20 from the corners of layers L is not possible.

It will be appreciated from FIGS. 17 and 18 that a discontinuous 'throat' TD is again created between the upward corrugations 66 on a lower slip sheet 62 and the downward corrugations 65 on an upper slip sheet 62, but provided the pitch of the corrugations is such that there will be at least one downward corrugation in register with each bottle top in the outermost rows, the rigidity afforded by the contiguous corrugations is such that 'walking' is prevented, and it has been proved by tests that, with corrugations having dimensions as shown in FIGS. 16 and 19 it is very difficult or even impossible to pull a bottle through the 'throat' TD.

Furthermore, tests have also revealed that vibration causes the bottles 20 in any layer L to move closer together, so that horizontal strapping 31 becomes redundant.

Because the corrugations can be moulded into a board of uniform thickness throughout with no increase in thickness along the sides and, as shown, even a thinning towards the edges, a plurality of like slip sheets 62 can be stacked compactly and with great stability by virtue of the corrugations 65, 66 of any slip sheet nesting in the corrugations of neighbouring slip sheets.

According to another aspect of the present invention, a palletised load of containers comprises upright containers stacked in layers on a pallet or dolly with slip sheets between the layers, also one below the bottom layer, the completed stack being topped-off by a further slip sheet and a rigid board, and strapping applied vertically between the pallet or dolly and the board, across under the platform of the pallet or dolly and across the top of the board, whilst subjected to a downward loading, characterised in that each slip sheet comprises a flat substantially rectangular board having diverging marginal portions in accordance with the previous aspect of the invention, creating between successive slip sheets a 'throat' preventing 'walking' of the containers from between those slip sheets or slipping upon shock loading.

Formation of the corrugations can be effected by injection moulding of the slip sheets or by hot pressing preformed sheets between platens with appropriate formations along the margins.

Upon arrival at the point of use, and after vertical strapping has been cut off and the rigid board and top slip sheet removed, the bottoms of each successive layer of bottles can slide up the upwardly projecting corrugations 66 along a side of the slip sheet 62 below as the layer is pushed laterally en masse from the board 63.

If the slip sheets 62 are used in conjunction with a device for alleviating slackening of vertical strapping 24 on palletised loads on containers such as is described in Co-pending Application No. 0512155.3 then it may be possible to reduce the number of vertical straps from, say, seven to four, without jeopardising the security of the layers L of bottles 20.

The invention claimed is:

1. A slip sheet (62) for use between layers (L) of upright containers (20) in a palletised load comprising a flat substantially rectangular board (63) having marginal portions (64) formed with corrugations (65, 66) extending perpendicularly from their edges and merging into the general plane of the board (63).

2. A slip sheet as in claim 1, wherein the board (63) has curved corners from which radiate diverging corrugations (65X, 66X).

3. A slip sheet as in claim 1 or claim 2 wherein the corrugations (65, 66, 65X, 66X) are moulded into a board (63) of uniform thickness throughout with no increase in thickness along the sides.

4. A slip sheet as in claim 1 or claim 2 wherein the corrugations (65, 66, 65X, 66X) are moulded into a board (63) of uniform thickness throughout with a thinning towards the edges.

5. A slip sheet as in claim 1 or claim 2, wherein the thickness of the board (63) is of the order of 1.0 to 3.0 mm and the maximum height of the upwardly projecting corrugations (66, 66X) and maximum depth of the downwardly projecting corrugations (65, 65X) is of the order of 2.0 to 4.0 mm.

6. A slip sheet as in claim 1 wherein the thickness of the board (63) is 2.5 mm, the length of the corrugations (65, 66) is 30.0 mm, the pitch of the corrugations is 15.0 mm, the maximum height of the upwardly projecting (66, 66X) corrugations and maximum depth of the downwardly projecting corrugations (65, 65X) is 3.0 mm, and the thickness at the edges is 1.25 mm.

7. A palletised load of containers comprising upright containers (20) stacked in layers (L) on a pallet (21) or dolly with slip sheets (62) between the layers, also one below the bottom layer, the completed stack being topped-off by a further slip sheet and a rigid board (23), and strapping (24) applied vertically between the pallet (21) or dolly and the board (23), across under the platform (25) of the pallet (21) or dolly and across the top of the board (23) whilst subjected to a downward loading, characterised in that each slip sheet (62) comprises a flat substantially rectangular board (63) having corrugated marginal portions (64) in accordance with any one of the preceding claims, creating between successive slip sheets (62) a 'throat' (T) preventing 'walking' of the containers (20) from between those slip sheets or slipping upon shock loading.

* * * * *